US005942848A

United States Patent [19]

Van Doorn et al.

[11] Patent Number: 5,942,848

[45] Date of Patent: Aug. 24, 1999

[54] COLOR DISPLAY DEVICE WITH PHOSPHOR REGIONS FOR EMITTING RED, BLUE AND GREEN LIGHT THROUGH RED-BLUE COLOR-FILLER LAYERS AND APERTURES IN A BLACK-MATRIX LAYER

[75] Inventors: Arie R. Van Doorn; Godefridus P. Van Melis, both of Eindhoven, Netherlands

[73] Assignee: U.S. Philips Corporation, New York, N.Y.

[21] Appl. No.: 08/950,569

[22] Filed: Oct. 15, 1997

[30] Foreign Application Priority Data

Oct. 17, 1996 [EP] European Pat. Off. ..... 96 202 889

[51] Int. Cl.[6] ..... H01J 29/10

[52] U.S. Cl. ..... 313/461; 313/466; 313/463; 313/473; 313/474; 313/112; 313/110

[58] Field of Search ..... 313/461, 466, 313/463, 473, 474, 112, 110

[56] References Cited

U.S. PATENT DOCUMENTS

| | | | |
|---|---|---|---|
| 5,045,750 | 9/1991 | Itou et al. | 313/466 |
| 5,640,066 | 6/1997 | Itou et al. | 313/461 |
| 5,686,787 | 11/1997 | Itou et al. | 313/461 |
| 5,700,609 | 12/1997 | Matsuda et al. | 430/27 |
| 5,703,431 | 12/1997 | Itou et al. | 313/461 |

FOREIGN PATENT DOCUMENTS

| | | | |
|---|---|---|---|
| 0720201 | 7/1996 | European Pat. Off. | H01J 9/227 |
| 2731826 | 1/1979 | Germany | H01J 29/32 |

*Primary Examiner*—Sandra O'Shea
*Assistant Examiner*—Ronald E. DelGizzi
*Attorney, Agent, or Firm*—John C. Fox

[57] ABSTRACT

A color display device for emitting, in operation, red, blue and green light having a substrate provided with a black matrix and only blue and red color filter layers.

5 Claims, 3 Drawing Sheets

COLOR DISPLAY DEVICE WITH PHOSPHOR REGIONS FOR EMITTING RED, BLUE AND GREEN LIGHT THROUGH RED-BLUE COLOR-FILLER LAYERS AND APERTURES IN A BLACK-MATRIX LAYER

CROSS REFERENCE TO RELATED APPLICATIONS

U.S. patent applications Ser. No. 08/950,568 filed Oct. 15, 1997 and Ser. No. 08/950,570 filed Oct. 15, 1997 also relate to color display devices having color filter layers.

BACKGROUND OF THE INVENTION

The invention relates to a color display device comprising a substrate on which a black-matrix layer having apertures is provided, said color display device having a phosphor pattern of phosphor regions containing phosphors for emitting, in operation, red, blue and green light through the apertures in the black-matrix layer, with color-filter layers extending between the phosphor regions and the substrate.

Color display devices of the type mentioned in the opening paragraph are used, inter alia, in television receivers and computer monitors.

A color display device of the type mentioned in the opening paragraph is known. Said known color display device comprises a phosphor pattern which includes sub-patterns of phosphor regions luminescing red, green and blue light (hereinafter also referred to as "red", "green" and "blue" phosphors) and it further comprises a black matrix. A black matrix is a black layer provided with apertures or a system of black stripes on the substrate and (in part) between the phosphor regions of which the phosphor pattern is made up, which black-matrix layer improves the contrast of the picture displayed. The black matrix is provided with apertures in which colored layers (also referred to as color-filter layers) are provided, and a phosphor region of a corresponding color is deposited on said colored layers. The color-filter layer absorbs incident light of different wavelengths than the light emitted by the relevant phosphor. This leads to a reduction of the diffuse reflection of incident light and to an improved contrast of the picture displayed. In addition, the color-filter layer (for example a "red" layer) may absorb a part of the radiation emitted by the "red" phosphor, namely the part having wavelengths outside the red portion of the visible spectrum. By virtue thereof, the color point of the red phosphor is improved. The known color display device comprises a color-filter layer for each of the phosphors (red, green and blue). For clarity, it is observed that "red", "blue" and "green" color-filter regions have a relatively high transmission for, respectively, red, blue and green light. The color indication for the color-filter layers relates to the transmission properties of the filters, not to their color.

The known color display device has a number of shortcomings; in particular, the percentage of rejects, that is, the percentage of cathode ray tubes which do not meet the quality requirements, form a problem. Rejects lead to an increase of the cost price of the cathode ray tube and cause environmental problems. The rejected tubes have to be processed in an environmentally friendly manner.

OBJECTS AND SUMMARY OF THE INVENTION

It is an object of the invention to provide a color display device of the type mentioned in the opening paragraph, in which a reduction of one or more of the above-mentioned drawbacks is achieved.

To this end, a color display device in accordance with the invention is characterized in that a first color-filter layer extends over a first system of apertures in the black matrix, which correspond to a first system of phosphor regions, a second color-filter layer extends in a second system of apertures in the black matrix, which correspond to a second system of phosphor regions, with the first and the second color-filter layer comprising a red and a blue color-filter layer or a blue and a red color-filter layer, and the first and the second system of apertures corresponding to phosphor regions comprising phosphors for emitting a color (red, blue) which corresponds to the color-filter layers, and there is no green color-filter layer between the phosphor regions for emitting green light and the substrate.

In a color-display device in accordance with the invention, the contrast is substantially equal to that of the known display device comprising three color-filter layers, whereas the percentage of rejects is reduced and the picture-reproduction quality is improved in a number of respects. The inventors have recognized that this surprising combination of properties occurs only when a red and a blue color filter are combined.

Preferably, the first color-filter layer also extends over the black matrix and is provided with apertures which correspond to apertures in the black matrix, which do not belong to the first system of apertures.

In the preferred embodiment, the first color-filter layer and the second color-filter layer are different. The first color-filter layer is a more or less continuous layer which extends over the apertures in the black matrix for phosphor regions of the first color and over the black matrix, said first color-filter layer being provided with apertures corresponding to further apertures in the black matrix. The second color-filter layer is situated in a second system of apertures in the black matrix. As a result, color contamination is reduced.

Preferably, the size of the apertures in the first color-filter layer is such that said apertures correspond to the apertures of the second system, which are surrounded by an edge.

In these preferred embodiments, the first color-filter layer leaves an edge around the apertures of the second color uncovered. This leads to an improved color reproduction because material of the first color filter cannot deposit in the apertures of the second color, and phosphor haze and hence color contamination are reduced.

Preferably, the difference in thickness between the thickness of the second color-filter layer and the sum of the thicknesses of the black matrix and the first color-filter layer is less than 1 micrometer.

Relatively large differences in height may influence the homogeneity of the phosphor patterns. Inhomogeneities adversely affect the quality of the picture displayed. Differences in height below 1 $\mu$m have little effect on the homogeneity of the phosphor coatings.

These and other aspects of the invention will be apparent from and elucidated with reference to the embodiments described hereinafter.

BRIEF DESCRIPTION OF THE DRAWINGS

In the drawings.

The Figures are not drawn to scale. In general, like reference numerals refer to like parts.

DESCRIPTION OF THE PREFERRED EMBODIMENTS

Figure 1:
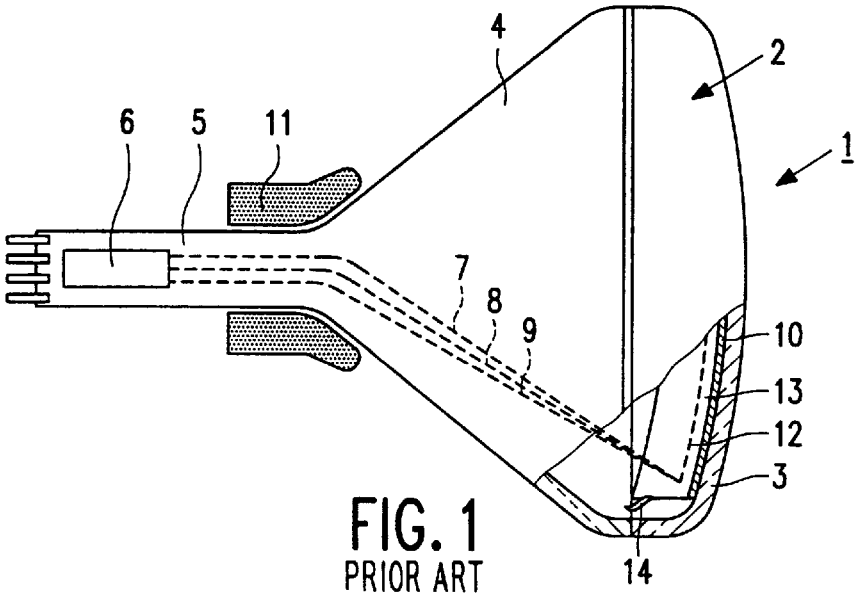
FIG. 1 PRIOR ART
FIG. 1 is a sectional view of a display tube.

A color display tube 1 (FIG. 1) comprises an evacuated envelope 2 including a display window 3, a cone portion 4 and a neck 5. In the neck 5 there is arranged an electron gun 6 for generating three electron beams 7, 8 and 9. A display screen 10 is provided on the inner surface of the display window. Said display screen 10 comprises a phosphor pattern of phosphor elements luminescing in red, green and blue. On their way to the display screen 10, the electron beams 7, 8 and 9 are deflected across the display screen 10 by means of a deflection unit 11 and pass through a shadow mask 12 which is arranged in front of the display window 3 and which comprises a thin plate having apertures. The shadow mask is suspended in the display window by means of suspension means 14. The three electron beams 7, 8 and 9 pass through the apertures 13 of the shadow mask at a small angle relative to each other and, consequently, each electron beam impinges on phosphor elements of only one color.

Figure 2A:
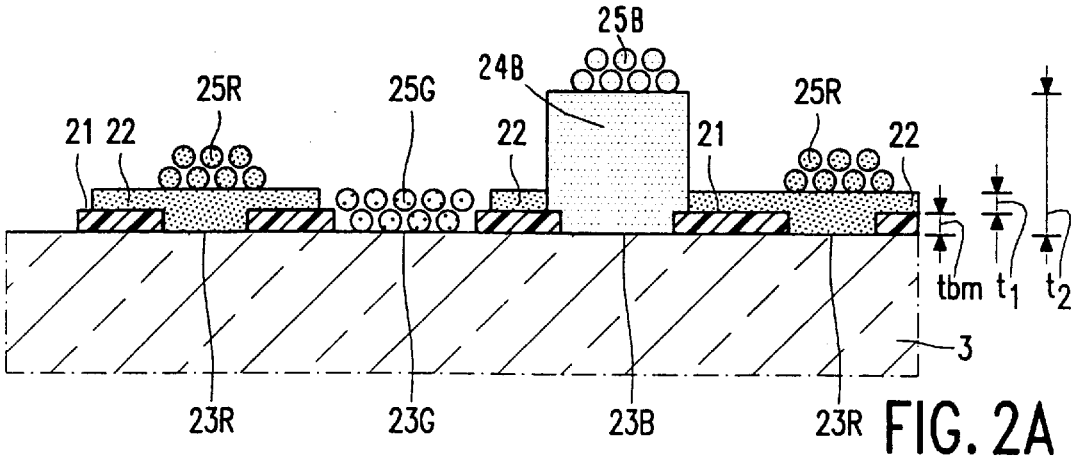
FIG. 2A is a sectional view of a display window for a display tube in accordance with the invention, which is provided with color-filter layers.
Figure 2B:
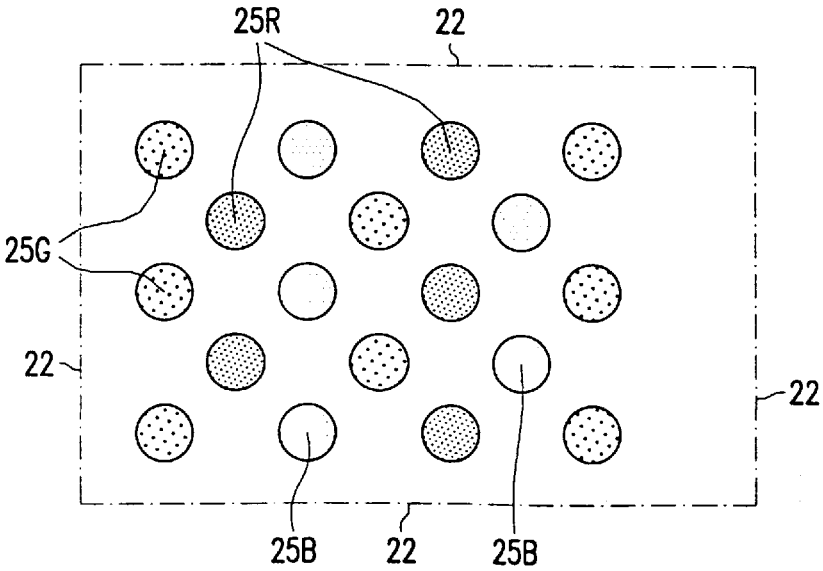
FIG. 2B is an elevational view of a display window for a display tube in accordance with the invention.

FIG. 2A is a sectional view of a display window of a color cathode ray tube in accordance with the invention. FIG. 2B is an elevational view (on the phosphor elements) of the display window shown in FIG. 2A. A black matrix 21 is provided on the inner surface of the display window. Color-filter layer 22 extends over apertures 23R for R (red) phosphor elements and over the black matrix 21, with the exception of the apertures 23B, 23G for, respectively, the B (blue) and G (green) phosphor elements. Regions of the color-filter layer 24B are provided in the apertures 23B. Said regions of the color-filter layer 24B project above the black matrix. In this example, the thickness $t_2$ of the color-filter layer 24B is 1.5–5 $\mu$m. Phosphors 25R, 25G and 25B are provided above the apertures 23R, 23G and 23B, respectively, with the color-filter layers, if any, extending between the phosphors and the substrate.

Figure 3A:
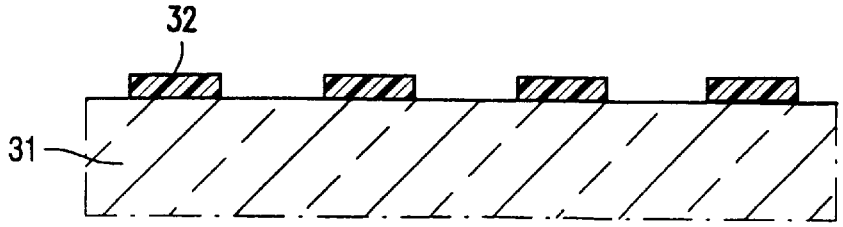
FIGS. 3A through 3J illustrate a method of manufacturing a color display device in accordance with the invention.
Figure 3B:
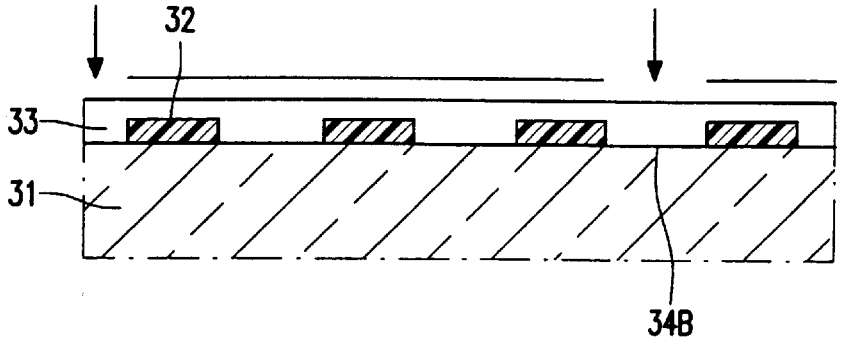
Figure 3C:
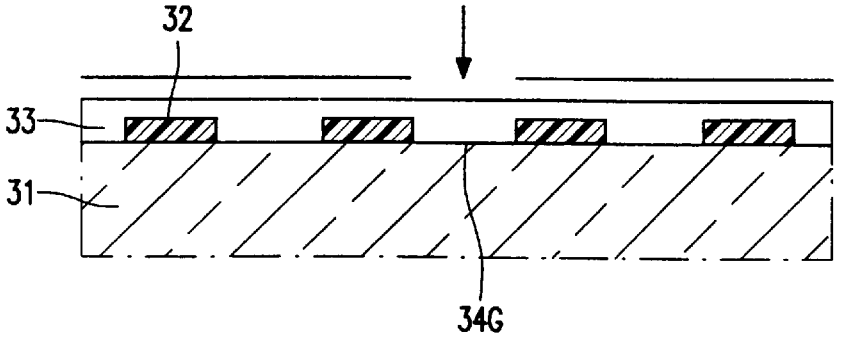
Figure 3D:
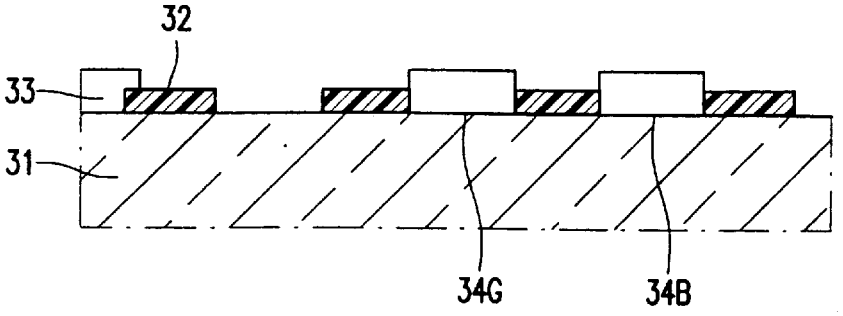
Figure 3E:
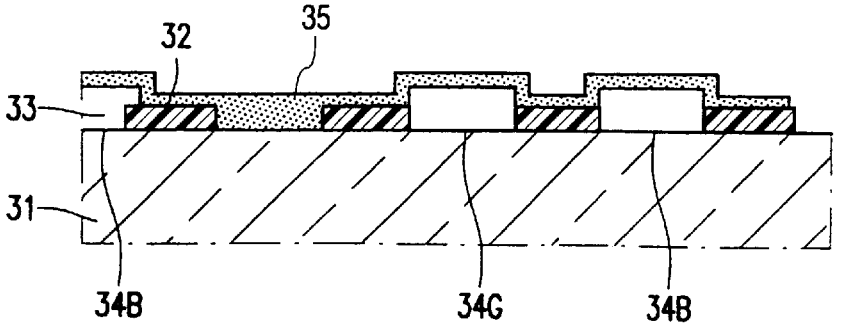
Figure 3F:
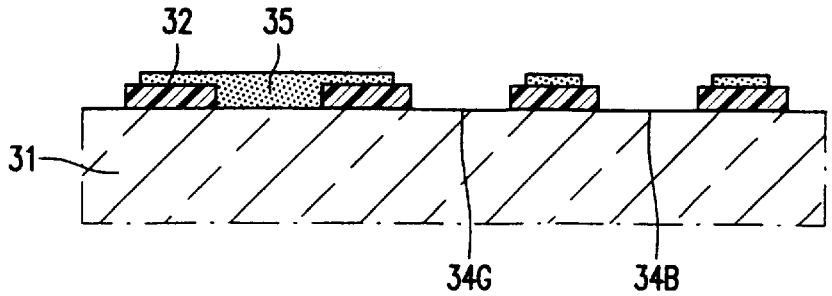
Figure 3G:
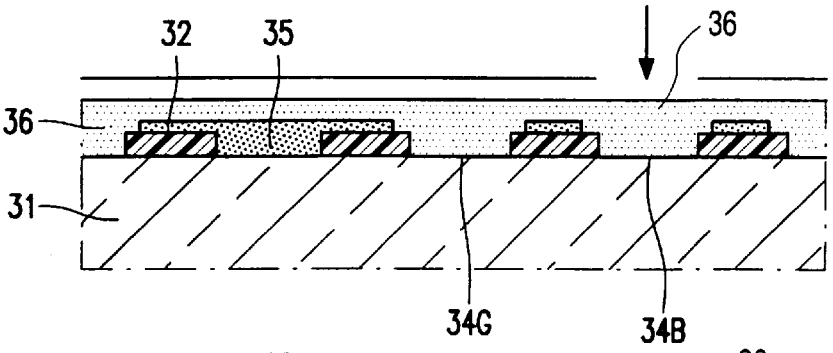
Figure 3H:
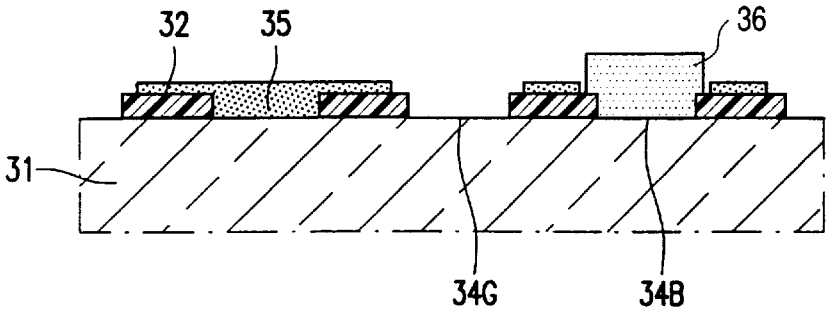
Figure 3I:
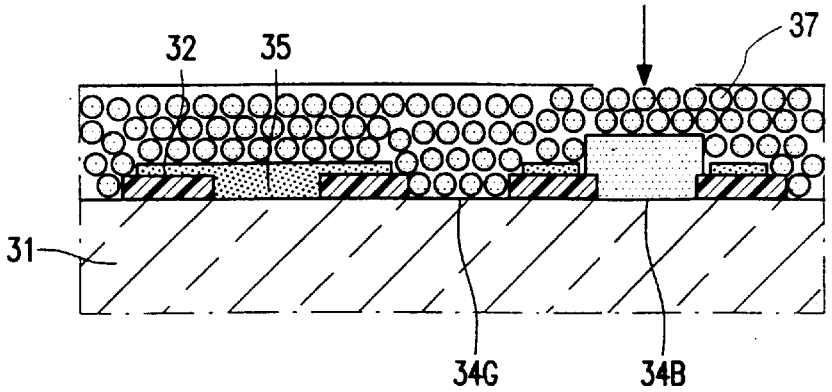
Figure 3J:
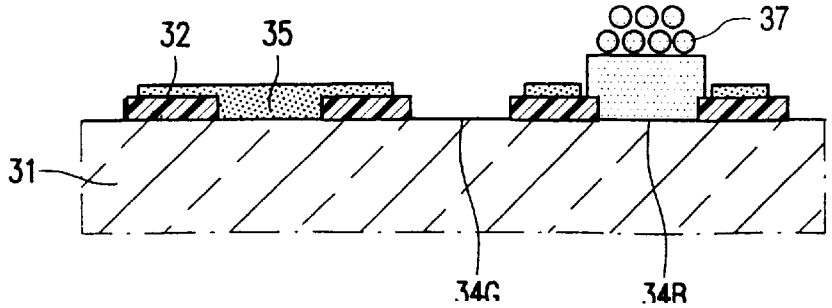

An example of a number of process steps of a method for the manufacture of the color display device in accordance with the invention is illustrated in FIGS. 3A through 3J. The method comprises the following steps.

a. Application of a black matrix 32 to a substrate 31; this operation can be carried out by means of known methods (FIG. 3A).
b. Application of a layer of a photoresist 33 to the substrate, exposure of said photoresist in and around apertures 34B and 34G in the black matrix. Said exposure is preferably carried out in such a manner that the exposed regions overlap the apertures in the black matrix and an edge around the apertures (FIGS. 3B and 3C).
c. Removal of the unexposed photoresist (FIG. 3D).
d. Application of a suspension 35 containing a first, for example red, dye. Drying said suspension (FIG. 3E).
e. Removal of the photoresist together with the dried suspension present on the photoresist (FIG. 3F) by means of, in this example, a so-called "lift-off process".
f. Application of a photoresist-suspension 36 containing a second, for example blue, dye. Exposure of said suspension through the mask (FIG. 3G).
g. Removal of unexposed suspension 36. In this example, the thickness of the suspension 36 is such that the exposed "blue" regions of the color layer project above the black matrix (FIG. 3H).
i. Application of photosuspension 37 containing blue-luminescent phosphors. Exposure of said photosuspension (FIG. 3I).

Subsequently, the other phosphors are provided by means of known techniques.

The inventors have recognized that the use of only a red and a blue color-filter layer, with preferably the red color-filter layer extending over the black matrix and surrounding the blue color-filter layers, has advantages which can be ascribed to the following:

Measurements have confirmed that the contrast of the picture reproduction is not noticeably improved by the application of a "green" color-filter layer. For example: the application of only a red color-filter layer leads to an increase of the contrast by approximately 7% relative to a color-display device without color-filter layers; the application of a red and a blue color-filter layer leads to an increase of the contrast by approximately 21%; the application of three (red, blue and green) color-filter layers leads to an increase in contrast by approximately 22%. Therefore, the surprising conclusion can be drawn that the provision of a green color-filter layer hardly influences the contrast. Apart from positive effects, however, the color-filter layers also have negative effects, i.e. they cause additional costs and a greater complexity of the method. Since each process step may be a source of rejects, color-filter layers lead to an increase in the number of rejects. In addition, color-filter layers cause phosphor haze. During the provision of the phosphors, contamination occurs, i.e. the "green" phosphor leaves traces on the "blue" color-filter layer and the "blue" phosphor leaves traces on the "green" color-filter layer. This leads to color impurity.

The red color-filter layer is very suitable for a so-called "lift-off process" and, in a preferred embodiment of the invention, the first color-filter layer is a red color-filter layer. Preferably, the following relationship applies:

$$|t_1+t_{BM}-t_2| \leqq |t_2-t_{BM}|$$

wherein $t_1$ is the thickness of the first color-filter layer or the black-matrix layer 22, $t_{BM}$ is the thickness of the black matrix and $t_2$ is the thickness of the second color-filter layer.

This preferred embodiment of the invention has the advantage that the color-filter regions (for example blue color-filter regions) projecting above the black matrix have a reduced negative effect on the flow behavior of the phosphor suspension(s) (37) when said phosphor suspension (s) is (are) provided. Depending on the pattern, regions comprising more or less (than average) of the phosphor suspension are formed in the display window. Eventually, this leads to the formation of clear and dark regions or stripes on the picture displayed. In the cathode ray tube in accordance with this preferred embodiment of the invention, the first color-filter layer is provided on the black matrix, so that the second color-filter layer projects less above its surroundings. As, in the preferred embodiment of the invention, the (red) color-filter layer 22 also extends over the black matrix between the (blue) regions of the color-filter layer, the differences in height are reduced. The thickness $t_{BM}$ of the black matrix is, for example, 0.5–0.7 micrometer, the thickness $t_1$ of the red color-filter layer 22 is 0.5–0.7 micrometer and the thickness $t_2$ of the blue color-filter layer 24B is 1.5–2.5 micrometers. By virtue of the presence of the red color-filter layer 22 around the blue regions of the color-filter layer 24B, the height of the regions 24B relative to the direct surroundings, i.e. how far these regions project above the surroundings, is reduced by 30 to 50%. This results in an improved homogeneity of the phosphor coating. FIG. 2A also shows an aspect of a preferred embodiment of the invention, namely that an edge around the apertures 23B in the black matrix 21 is left free by the color-filter layer 22. By virtue thereof, "red" color-filter material is prevented from entering apertures 23B and/or 23G. This results in an improved color reproduction.

It will be obvious that the invention is not limited to the examples described hereinabove. For example, in FIG. 1 a conventional color-cathode ray tube is shown. Within the scope of the invention, the term "color-display device" should be interpreted in a broad sense so as to include any display device comprising a pattern of phosphors in three luminescent phosphors on a substrate. Color display devices include flat display devices of various types, such as plasma displays. Suitable materials for the red and blue color filters are e.g. ironoxyde (red) and cobolt aluminate (blue).

We claim:

1. A color display device consisting of a substrate on which a black matrix layer is provided, said color display device having a phosphor pattern of phosphor regions for emitting, in operation, red, blue and green light through the apertures in the black matrix layer, with color-filter layers extending between the phosphor pattern and the substrate, characterized in that:

a first color-filter layer extends over a first series of apertures in the black matrix, which first series of apertures correspond to the phosphor regions of a first color, a second color-filter layer extends over a second series of apertures in the black matrix which second series of apertures correspond to the phosphor regions of a second color, said first and second color-filter layer comprising a red and a blue color-filter layer respectively or a blue and a red color-filter layer respectively, the first and second series of apertures in the black matrix comprising phosphors for emitting a color which corresponds to the color-filter layers and no green color-filter layer is present between the phosphor regions for emitting green light and the substrate.

2. A color display device as claimed in claim 1, wherein the first color-filter layer also extends over the black matrix and is provided with apertures which correspond to the apertures of the second series, which apertures of the second series are surrounded by an edge.

3. A color display device as claimed in claim 2, characterized in that the first color-filter layer is a red color-filter layer.

4. A color display device as claimed in claim 1, characterized in that $$|t_1+t_{BM}-t_2|<|t_2-t_{BM}|$$

wherein $t_1$ is the average thickness of the first color-filter layer, $t_{BM}$ is the average thickness of the black matrix and $t_2$ is the average thickness of the second color-filter layer.

5. A color display device as claimed in claim 1, characterized in that the second color-filter layer projects less than 1 $\mu$m above the first color-filter layer.

* * * * *